United States Patent [19]

Taylor

[11] 4,046,207

[45] Sept. 6, 1977

[54] EARTH DRILLING TOOLS

[76] Inventor: Thomas Lee Taylor, Box 6048, Odessa, Tex. 79760

[21] Appl. No.: 719,620

[22] Filed: Sept. 1, 1976

[51] Int. Cl.[2] ..... E21B 9/22

[52] U.S. Cl. ..... 175/391; 175/394

[58] Field of Search ..... 175/391, 392, 394, 413, 175/323

[56] References Cited

U.S. PATENT DOCUMENTS

| | | | |
|---|---|---|---|
| 1,803,183 | 4/1931 | Hardsocg | 175/413 |
| 2,578,014 | 12/1951 | Petersen | 175/392 |
| 3,235,018 | 2/1966 | Troeppl | 175/391 |
| 3,794,129 | 2/1974 | Taylor | 175/391 |
| 3,898,895 | 8/1975 | Taylor | 175/391 X |

FOREIGN PATENT DOCUMENTS

| | | | |
|---|---|---|---|
| 646,430 | 8/1962 | Canada | 175/391 |

*Primary Examiner*—Ernest R. Purser
*Assistant Examiner*—Richard E. Favreau
*Attorney, Agent, or Firm*—Marcus L. Bates

[57] ABSTRACT

An auger for boring holes through the surface of the earth. The auger is provided with a double flight which concurrently spirals about the hub of the auger, with the leading edges of the flights being arranged in opposition to one another.

Digging teeth are mounted in spaced relationship within the leading edge of each flight, with the innermost tooth of each opposed flight being located 180° apart, at different radii, and at different elevations respective to one another.

Other teeth are spaced 180° apart and located in each leading edge. The teeth are angularly displaced from the innermost teeth and arranged at different vertical elevations and different radii respective to one another.

Additional teeth may be positioned on the leading edge of either flight. Adjacent teeth located in the leading edge of either flight are progressively spaced radially and vertically respective to one another.

This unique arrangement of the digging teeth provides a step-type auger wherein adjacent teeth of one flight cut spaced-apart trenches, while teeth located on the opposed flight cut the area located between the trenches.

9 Claims, 6 Drawing Figures

EARTH DRILLING TOOLS

BACKGROUND OF THE INVENTION

Augers are utilized for boring shallow holes through the surface of the earth. The specific design of any individual auger is usually dependent upon the geology of the strata or formation being penetrated. Some augers are provided with an abundance of excavating teeth, while other augers may be provided with a single or dual cutting surface. The number of cutting teeth placed on the flight of an auger determines the rate of penetration, as well as having a drastic influence on the initial cost of the auger.

The number of teeth also determine the maximum bearing pressure an individual tooth can effect upon the formation being penetrated, and the greater the number of teeth, the less the bearing pressure any one tooth can exert upon a particular formation.

In my previously issued U.S. Pats. No. 3,898,895 and No. 3,794,129, there is disclosed a step-type auger having the teeth thereof arranged in a particular pattern so as to achieve greater efficiency during the boring operation. Reference is made to these two issued patents for further background of the present invention, as well as to the art cited therein.

The present invention relates to improvements in augers by the provision of a dual flight which commences in proximity of a pilot bit and presents diametrically opposed leading edges having digging teeth affixed thereto. The teeth are arranged in a particular pattern which greatly enhances the boring efficiency, as well as the rate of penetration, and at the same time, provides for a substantial reduction in cost.

SUMMARY OF THE INVENTION

This invention relates to an auger for boring holes through the surface of the earth. The auger includes a dual flight, each flight has a leading edge which commences adjacent a pilot bit and a trailing edge which terminates adjacent a chuck thereof.

The two flights concurrently spiral about an axial hub member in parallel relationship respective to one another. Teeth located in the leading edge of the flights are arranged with spaced, opposed innermost teeth which are spaced apart 180° from one another and which are located along different radii and elevations respective to one another.

A second tooth is located on either flight with the second teeth each being spaced 180° apart, and disposed at different vertical elevations and different radii respective to one another. Hence, each of the teeth engage and dig along a different annular digging path.

In one embodiment of the invention there is disclosed other digging teeth which are arranged along a different radii and a different elevation respective to the remaining teeth in either of the flights.

The teeth are therefore placed in opposed pairs on the opposed leading edges of dual flights, with the pairs of teeth being 180° apart, disposed at different radii, and arranged at different elevations respective to one another, with the first tooth being arranged to cut a first annular area, and the last tooth being arranged to cut a different annular area, and with the remaining teeth being arranged in overlapping relationship for cutting other annular areas so that the resulting configuration of unexcavated material is in the form of a series of annular steps.

A primary object of the present invention is to provide improvements in the design and operation of augers.

Another object of the invention is to provide a novel arrangement of digging teeth mounted on an auger which greatly increases the efficiency thereof.

A further object of this invention is to disclose and provide an improved tooth pattern for an auger which results in unexpected improvements in the performance thereof.

A still further object of this invention is to provide an auger having digging teeth arranged on the leading edges of a double flight in a special pattern which greatly increases the rate of penetration thereof.

Another and still further object of the present invention is to provide a double flight auger having a minimum of digging teeth arranged in a novel, stepped pattern which increases the efficiency of operation and reduces the cost thereof.

An additional object of the present invention is the provision of an auger having digging teeth mounted in the leading edge of a double flight with the teeth being arranged respective to one another to cause each individual tooth to dig an annular area so that the bottom of the excavated hole is of a stepped configuration.

Another object of the invention is to provide an auger having a plurality of teeth located in each leading edge of a dual flight, with a tooth in one flight lying along a common vertical plane with a tooth in the other flight, and with the teeth being at different radii and vertical elevations respective to one another, to thereby provide unexpected efficiency in the rate of penetration of the auger.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
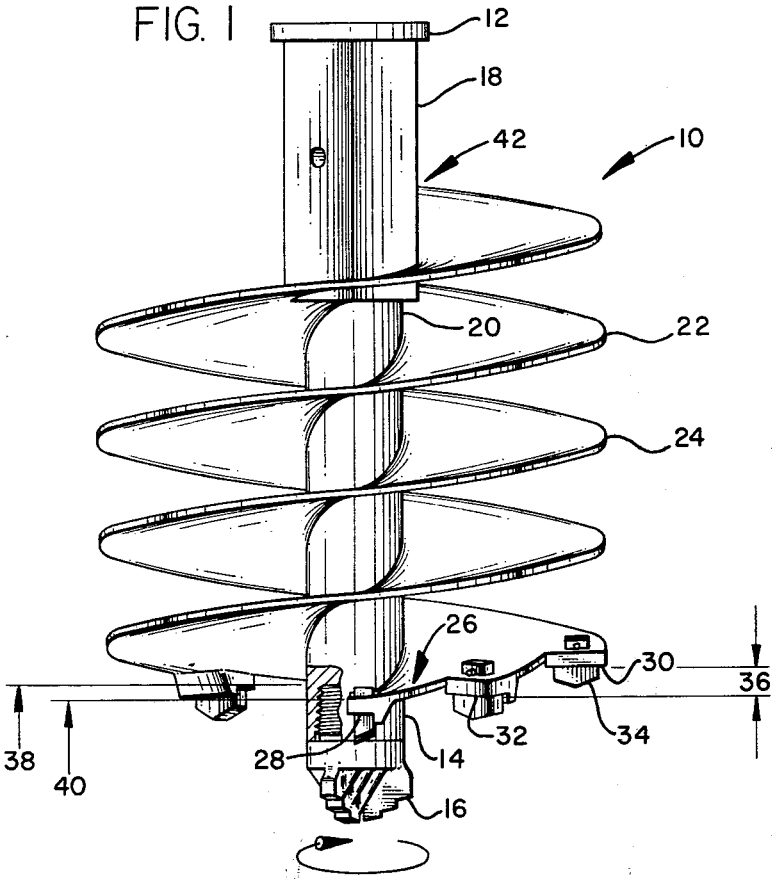
FIG. 1 is a part cross-sectional, side elevational view of an auger made in accordance with the present invention.

FIG. 1 illustrates an auger 10 for boring holes through the surface of the earth. The auger has an upper end 12 and a lower end 14. A pilot bit 16 is removably affixed to the lower end 14. A chuck 18 forms the upper marginal end of the auger for connection to a prime mover (not shown) in a manner which is known to those skilled in the art.

An axial hub member 20 is rigidly affixed to the inner edge of two spaced, parallel flights 22 and 24. The flights each have the illustrated outer rim which spirals about the axial hub member in the usual manner.

As seen in FIGS. 1–4, a first flight 24 has a leading edge 26 made in a particular configuration, according to this invention, for receiving a plurality of excavating teeth therein.

The teeth are preferably removably received within individual, spaced, tooth-receiving pockets of a conventional design, such as seen illustrated in my above mentioned patents, for example.

Pocket 28 is formed in the leading edge of flight 24 and provides a means for mounting the innermost tooth. Tooth holder 30 is located at the outer extremity of the leading edge of the flight, while intermediate tooth holder 32 is placed between the innermost and outermost tooth holders. Digging teeth 34 are removably received within each of the pockets 28, 30, and 32. It should be noted that digging teeth 34 are interchangeable between all the various teeth-receiving pockets.

As seen indicated in FIG. 1 by the arrows at numeral 36, each of the adjacent pockets, 30 and 32, for example, are located at different elevations respective to one another, with the outermost pocket being at the highest elevation, and the innermost pocket being at the lowest elevation.

Numeral 38 indicates the elevation of the innermost leading edge portion of flight 22, while numeral 40 indicates the elevation of the innermost leading edge portion of flight 24. The arrow at numeral 42 indicates the uppermost or trailing end of flight 24 which terminates adjacent the chuck 18.

Figure 2:
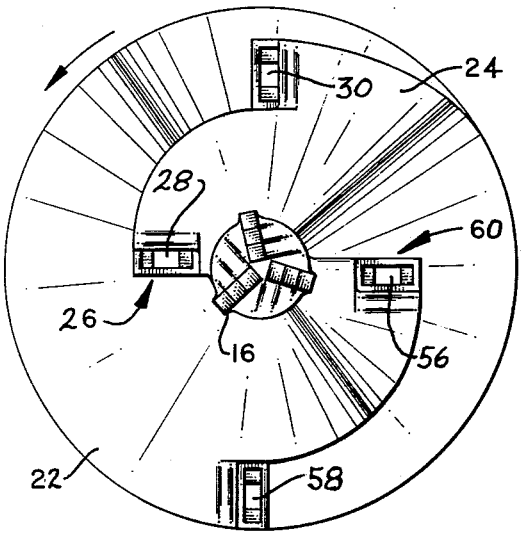
FIG. 2 is a bottom view of a modification of the auger disclosed in FIG. 1.

In the specific embodiment of FIG. 2, an auger having a dual flight is disclosed, with each flight having a leading edge within which two spaced excavating teeth are located. Pockets 28 and 30 are located on the leading edge 26 of one flight, while pockets 56 and 58 are located on the leading edge of the remaining flight.

Pocket 28 is diametrically opposed to pocket, 56, with pocket 28 lying along a radius which is shorter than the radius of pocket 56. Pocket 30 is similarly spaced a shorter distance from the longitudinal axial centerline of the hub member as compared to pocket 58.

Figure 3:
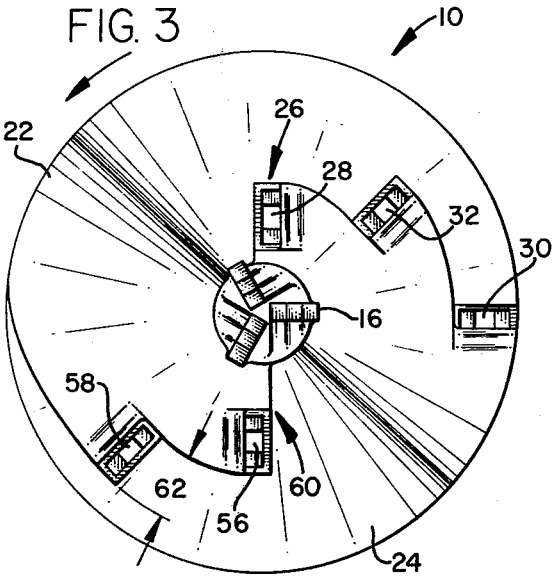
FIG. 3 is a bottom view of a modification of the auger disclosed in FIG. 2.

In the specific embodiment of FIG. 3, the leading edge 26 of the flight 24 is provided with an odd number of teeth, with the first flight having an innermost tooth located closer to the hub member and at a lower elevation 40 (FIG. 1), respective to the corresponding opposed excavating tooth 56 located on the second flight. The intermediate teeth 32 and 58 are arranged 180° apart, while there is no opposed excavating tooth for member 30. Hence the auger of FIG. 3 has an asymmetrical tooth pattern.

Figure 4:
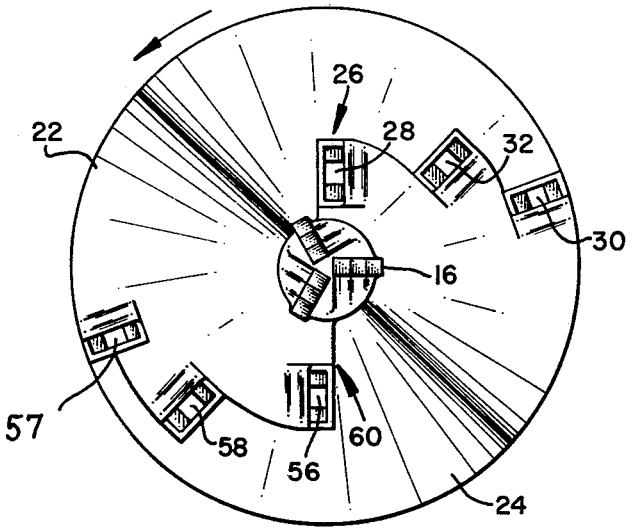
FIG. 4 sets forth a modification of the auger disclosed in the foregoing figures.

FIG. 4 illustrates another form of the auger of the present invention which includes an equal number of teeth in the leading edge of each of the flights, with the pockets 28 and 32, respectively, being located closer to the central hub member as compared to the pockets 56 and 58, respectively. Pockets 30 and 57 are located along the same diameter and are arranged at identical radii respective to the hub member, thereby stabilizing the rotating auger.

In FIG. 4, it will be noted that a tooth located in the pocket at 28 digs an annular area which is overlapped by a tooth located in the pocket at 56, which is similarly related to a tooth located in the pocket 32. Accordingly, the corresponding teeth of opposed flights are staggered both radially and vertically respective to one another.

Figure 5:
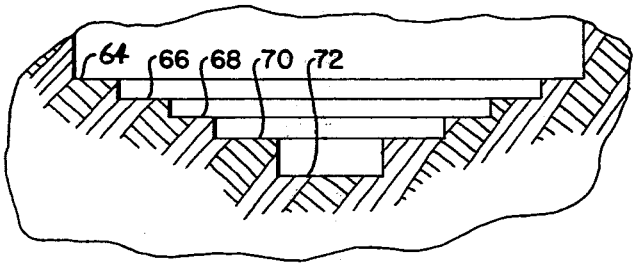
FIG. 5 is an isolated, cross-sectional view of part of a formation having a borehole formed therein; and, FIG. 6 is a diagrammatical illustration pertaining to the operation of the present invention.

Excavating or digging teeth are placed within the pockets of the auger and form a borehole such as schematically illustrated in FIG. 5, with the central portion 72 of the hole being formed by the pilot bit, and the four annular, stepped annulus 64–70 being formed by the four digging teeth of FIG. 2 which are received within the pockets 28, 30, 56, and 58.

Figure 6:
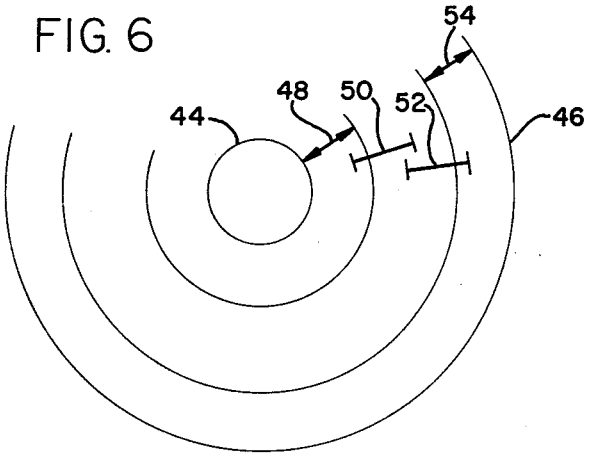

In FIG. 6, numeral 44 is a circle indicating the diameter of a hole formed by a pilot bit 16. Numeral 48 indicates the width of an annulus formed by an innermost cutting tooth 28. Numeral 50 indicates the width of the next innermost cutting tooth 56 of FIG. 2, for example. Numeral 52 indicates the width of the next adjacent cutting tooth, while numeral 54 indicates the width of the outermost tooth of the auger. Numeral 46 broadly indicates the diameter described by the outermost portion of the outermost tooth 30, for example.

It is preferred to arrange the first opposed teeth 28 and 56 so that they overlap less than the teeth located adjacent to the rim of the flight for the reason that the outermost teeth must remove considerably more material as compared to the requirements of the innermost teeth.

The individual pairs of teeth 28, 56 and 32, 58 are preferably arranged with the cutting edge thereof disposed along a radius drawn from the longitudinal centerline of the axial hub member. The teeth 28, 56 or 32, 58 lie along a common vertical plane and at different vertical elevations respective to one another.

I claim:

1. An auger comprising an elongated axial hub member which terminates in a chuck at the upper end thereof and which terminates in a pilot bit at the lower end thereof;

two spaced flights each having an inner edge affixed to said hub, with said flights radiating from said hub to form a spiraling outer rim; each of said flights having an upper end which terminates adjacent to said chuck and a lower end which terminates adjacent to said pilot bit, the lower end of each of said flights being in the form of a leading cutting edge;

the leading edge of one flight commencing at a different vertical elevation respective to said pilot bit as compared to the leading edge of the remaining flight;

the leading cutting edge of each of said flights having a plurality of cutouts formed therein with each cutout being spaced circumferentially, vertically, and radially from one another, means mounting a tooth receiving pocket within each said cutout, thereby enabling a plurality of spaced digging teeth to be received by the leading edge of each flight;

said teeth on one flight being arranged with an innermost tooth located adjacent to said hub, and an outermost tooth located near the outer rim of said flight;

said teeth on the remaining flight being arranged with an innermost tooth located adjacent to said hub and an outermost tooth located near the outer rim of said remaining flight;

each successive tooth of a flight being progressively spaced circumferentially, radially, and vertically respective to said innermost tooth; the innermost tooth of one flight being disposed 180° from the innermost tooth of the remaining flight, and each of said innermost teeth lying at different radii respective to the axial centerline of said hub.

2. The improvement of claim 1 wherein said innermost digging tooth on said second flight is arranged at a radius which is intermediate the radii of the innermost and outermost digging tooth of said first flight.

3. The auger of claim 1 wherein the innermost leading edges of said first and second flights are vertically spaced apart from one another and commence at 180° spaced relationship respective to one another.

4. The auger of claim 1 wherein there are two digging teeth affixed to the leading edge of said first flight;

said second flight includes two digging teeth;

the first tooth of said second flight being located on a radius which is greater than the radius of said first tooth and less than the radius of said second tooth of said first flight;

and the outermost tooth of said second flight lies at a greater radius respective to the outermost tooth of said first flight.

5. An auger for boring holes through the surface of the earth, a chuck, a pilot bit, said auger having an axial hub member which terminates in said chuck at the upper end thereof and which terminates in said pilot bit at the lower end thereof;

two spaced flights each having an upper end, a lower leading edge, an outer rim, and an inner edge; said inner edge of each flight being affixed to said hub member with the upper end of each flight terminating in close proximity of said chuck and the lower leading edge terminating in close proximity of said pilot bit; the leading edge of one flight commencing at a different vertical elevation respective to the pilot bit and leading edge of the other flight;

the leading edge of each said flight being opposed to one another and having a plurality of cutouts formed therein with each said cutout being spaced circumferentially, vertically, and radially from one another; a tooth receiving pocket rigidly mounted in each said cutout; a digging tooth mounted in each said pocket; there being an innermost tooth spaced from an adjacent tooth on each said leading edge;

said innermost tooth on said first flight being located 180° from said innermost tooth on said second flight;

said adjacent tooth on said first flight being located 180° from a corresponding adjacent tooth on said second flight;

each said tooth being located at a different radii and a different vertical elevation respective to each other and to said pilot bit.

6. The auger of claim 5 wherein said innermost digging tooth on said second flight is arranged at a radius which is intermediate the radii of the innermost and outermost digging tooth of said first flight.

7. The auger of claim 5 wherein the innermost leading edges of said first and second flights are vertically spaced apart from one another and commence at 180° spaced relationship respective to one another.

8. The auger of claim 5 wherein there are two digging teeth affixed to the leading edge of said first flight;

said second flight includes two digging teeth;

the first tooth of said second flight being located on a radius which is greater than the radius of said first tooth and less than the radius of said second tooth of said first flight;

and the outermost tooth of said second flight lies at a greater radius respective to the outermost tooth of said first flight.

9. An auger for boring holes through the surface of the earth, a chuck, a pilot bit, said auger having an axial hub member which terminates in said chuck at the upper end thereof and which terminates in said pilot bit at the lower end thereof;

two spaced flights each having an upper end, a lower leading edge, an outer rim, and an inner edge; said inner edge of each flight being affixed to said hub member with the upper end of each flight terminating in close proximity of said chuck and the lower leading edge terminating in close proximity of said pilot bit;

the leading edge of each said flight being opposed to one another, and arranged at different vertical elevations respective to one another, and having a plurality of digging teeth mounted thereon; there being an innermost tooth spaced from an adjacent tooth on each said leading edge; a plurality of cutouts formed in each said leading edge, each said cutout being spaced from the other said cutouts vertically, circumferentially, and radially, a tooth receiving pocket affixed in each said cutout thereby providing mounting means by which said plurality of teeth are mounted on said leading edge of each said flight;

the teeth on one flight includes a first tooth located adjacent said hub with the remaining teeth of said first flight being located along different radii and at different elevations along said leading edge;

the teeth on the remaining flight include a first tooth located adjacent said hub at a different radius respective to said first tooth of said first flight, said first tooth of each said flight being located 180° apart respective to the longitudinal axis of said hub member.

* * * * *